US006315283B1

(12) United States Patent
Haas et al.

(10) Patent No.: US 6,315,283 B1
(45) Date of Patent: Nov. 13, 2001

(54) INPUT HOPPER AND ENCODING STATION FOR CARD PRINTER

(75) Inventors: Darren W. Haas, Eden Prairie; Brent D. Lien, Minneapolis; Thomas J. Reynolds-Kotz, Burnsville; John P. Skoglund, Savage, all of MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 09/310,770

(22) Filed: May 10, 1999

(51) Int. Cl.[7] ..... B65M 1/06

(52) U.S. Cl. ..... 271/124; 271/121; 271/10.09; 271/10.11; 271/10.13; 271/113; 271/116; 271/171

(58) Field of Search ..... 271/10.09, 10.11, 271/10.13, 113, 116, 121, 124, 171

(56) References Cited

U.S. PATENT DOCUMENTS 4,032,135 * 6/1977 Ruenzi ..... 271/116
5,769,408 * 6/1998 Selak et al. ..... 271/10.03
5,814,796 * 9/1998 Benson et al. ..... 235/375
5,941,522 * 8/1999 Magstrom et al. ..... 271/225
6,017,031 * 1/2000 Oosawa et al. ..... 271/121

* cited by examiner

*Primary Examiner*—Donald P. Walsh
*Assistant Examiner*—Jonathan R. Miller
(74) *Attorney, Agent, or Firm*—Westman, Champlin & Kelly, P.A.

(57) ABSTRACT

A card feeder for a card printer provides a stack of cards at an input end of the printer. The cards are supported on a pair of rollers that are driven at differential speeds and through one-way clutches so that a card being fed from the stack will pass through an outlet opening and can be accelerated by further drives. The outlet opening is controlled as to size by a slidable gate that permits changing the thickness of the opening to permit use of different thickness cards in the hopper. The feeder includes cleaning rollers that are formed as a module that can be inserted and replaced, and also an encoding station where the card can be encoded such as for a magnetic strip, or for non contact radio frequency or other smart card chips contained on the card being processed prior to the printing operation.

23 Claims, 14 Drawing Sheets

INPUT HOPPER AND ENCODING STATION FOR CARD PRINTER

BACKGROUND OF THE INVENTION

The present invention relates to a feeder and encoding assembly that is used in connection with printers, and it is for ID card image printers that provide for adjustability for the individual card width and thicknesses, and permits encoding either using a magnetic coding, or a proximity coding such as would be used with radio frequency or SmartCard encoding systems.

The prior art has shown various card feeders and encoders, including encoders that will encode or program smart card chips, as well as provide magnetic information on strips carried on cards. The ability to adapt feeders for different size and thickness cards to reliably feed the cards into an encoding station is needed, and the encoder itself has to be able to accommodate such changes in card size, particularly the width of the cards, and variation into location of the encoding media. Present card feeders have problems with card separation, namely reliably feeding only one card at a time, particularly when changing from one card thickness to another.

An example of an encoder arrangement is shown in copending U.S. patent application Ser. No. 08/854,969, filed May 13, 1997, and assigned to the same assignee as this application now U.S. Pat. No. 5,941,522 issued Aug. 24, 1999.

SUMMARY OF THE INVENTION

The present invention relates to a card feeder that will receive a stack of cards, which are of the same size. The feeder has a hopper which can be easily adjusted for different width cards. The card feeder hopper has feed rollers at the bottom that form an inclined support plane at an inclination toward the fed card receiving support so the cards are inclined and tend to be fed "downhill". The inclined plane also is at other than 90° relative to the leading edge plane of the cards held in the hopper in order to enhance the feeding capabilities.

The cards are fed through cleaning rollers that pick up dust and small particles and wipers used for removing electrostatic charge from the cards. Then the cards are fed through a feed slot that can be adjusted in height to accommodate different thickness of cards reliably.

Another aspect of the disclosure is that the cards are fed from the hopper into an encoding station, prior to printing. A "flipper" table on which the cards are placed after leaving the feeder directs the cards to the encoding station. A flipper table is shown and described in copending application Ser. No. 08/854,969, filed May 13, 1997, and now U.S. Pat. No. 5,941,522 and incorporated above. Various sensors are used for determining that the card is properly positioned, and the card to be encoded then can be fed into an encoding station either for magnetic encoding or to a proximity encoder that does not have to contact the card. Proximity encoders are used where radio frequency signals are applied, or where other non-contact signal format is utilized. The encoder station has a side edge guide that is spring loaded to automatically accommodate cards of different widths.

By having the drive rollers at the bottom of the feed hopper inclined at a particular relationship to the stack of the cards, and to the table or support that receives the cards, the cards are fed reliably. The rollers are operated at speeds which ensure that if slippage occurs, the cards will still be properly introduced into the system. Card sensors are utilized at critical points for determining the presence of cards for initiating the encoding and subsequent printing sequence.

Since the cards are encoded prior to printing, the encoding can be verified before printing and if the card does not encode properly, it can be rejected and not printed. Printing is a costly process, so printing cost can be saved if either the encoding or the card is faulty.

Cleaning rollers that ensure that the cards are in appropriate condition for not only encoding but also for subsequently printing, are provided, and the cleaning rollers are in a module form that can be removed from the assembly without special tools.

Any type of printer can be utilized, but it is envisioned that a ID card printer would receive the encoded cards and then the printing process would occur.

DETAILED DESCRIPTION OF THE PREFERRED EMBODIMENTS

Figure 1:
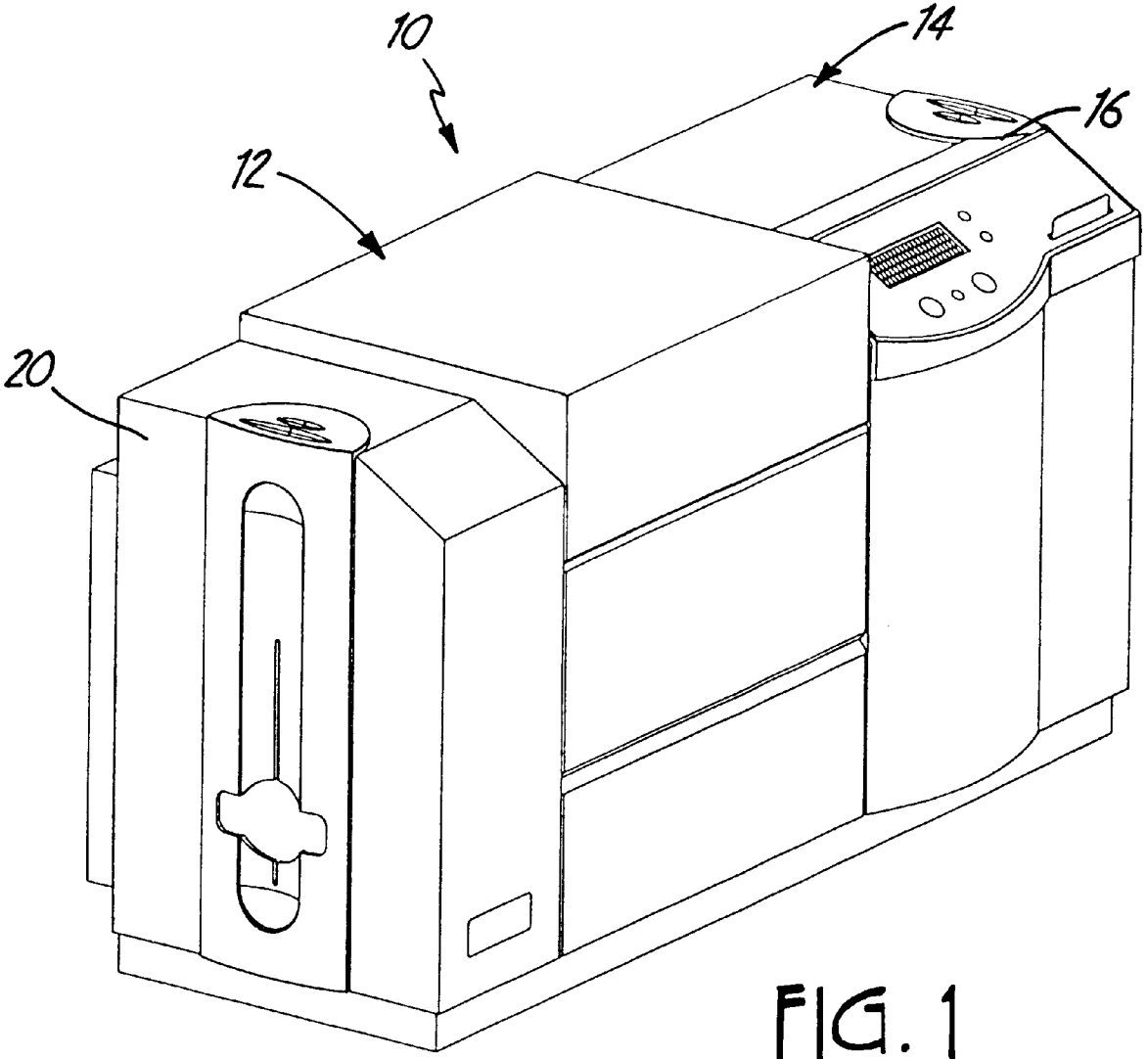
FIG. 1 is a perspective view of a printer and card feeder assembly including a card feeder and encoder made according to the present invention.

A printer and card feeder indicated generally at 10 in FIG. 1 shows a typical card printer that is used with the feeder of the present invention. The printer 12 is connected to an output end of the card feeder and encoder assembly 14 and as shown, the card feeder can have a removable cover 16 for permitting access to the interior of the assembly where a card hopper shown in FIG. 2, generally at 18, is illustrated. An output card tray 20 is shown in FIG. 1, where the printed cards are deposited after processing.

Figure 2:
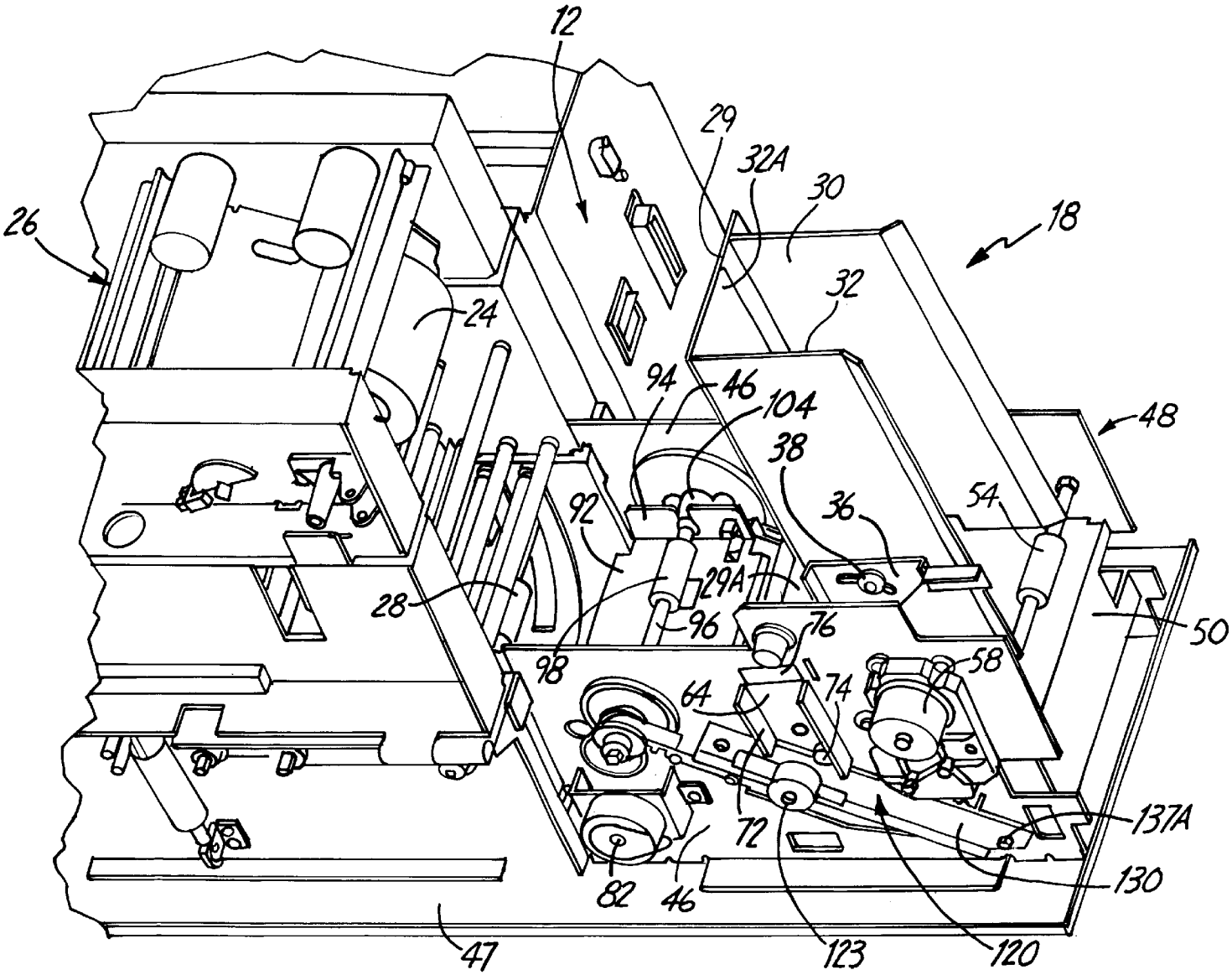
FIG. 2 is a perspective view of the card feeder and a fragmentary portion of a typical printer that receives cards with the outer cabinet removed.

While the printer 12 is shown in one form, various types of printers can be utilized. Referring to FIG. 2, the printer 12, as shown has a printer frame 22, that mounts desired components, including a print ribbon take-up spool 24, and a printhead 26 that will print images onto a card that is fed in from the card hopper 18. The printer feed mechanism for cards is not illustrated but does include a drive roller 28.

Figure 4:
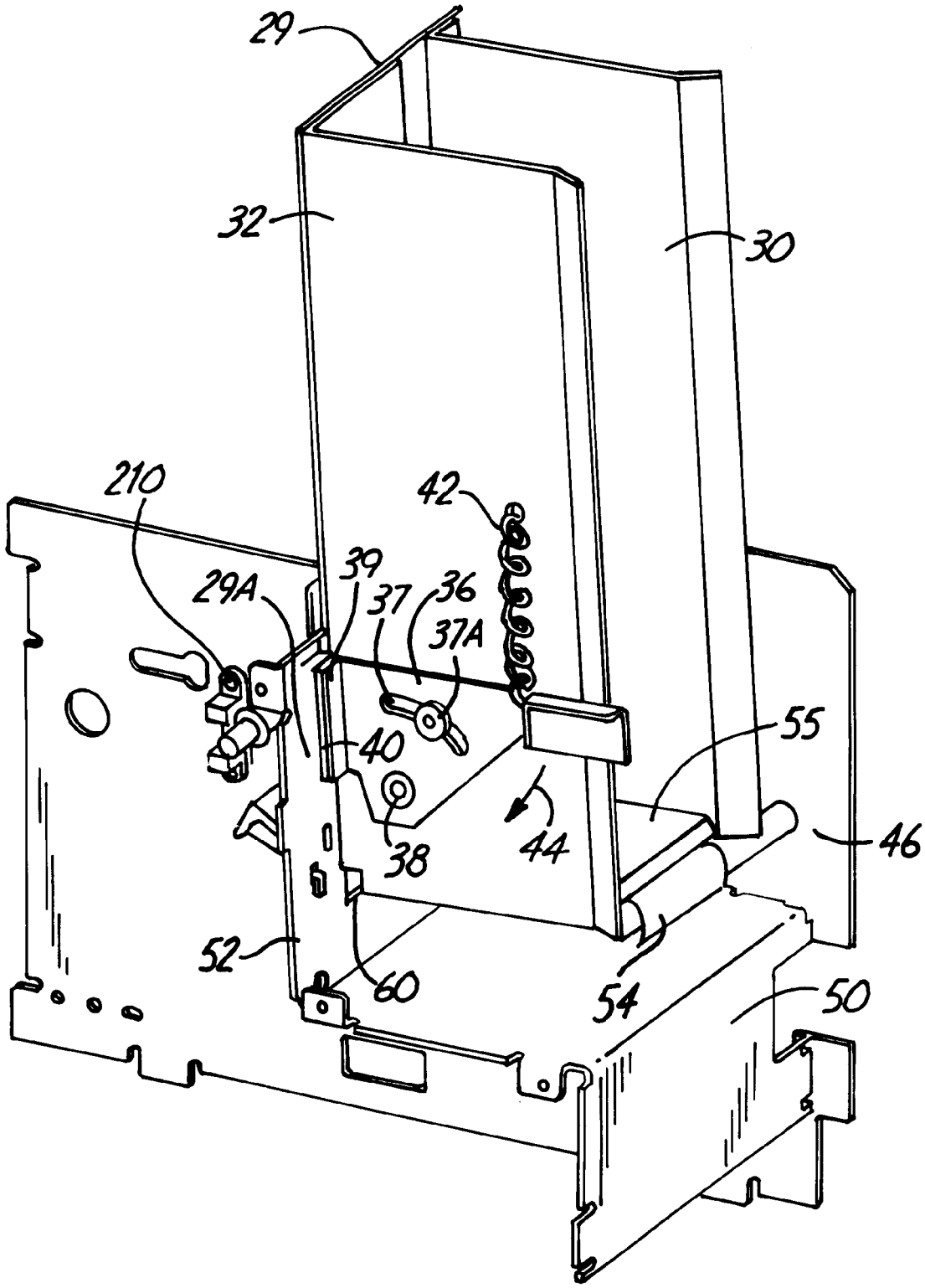
FIG. 4 is a perspective view of the input hopper with one side wall removed for showing details clearly.
Figure 7:
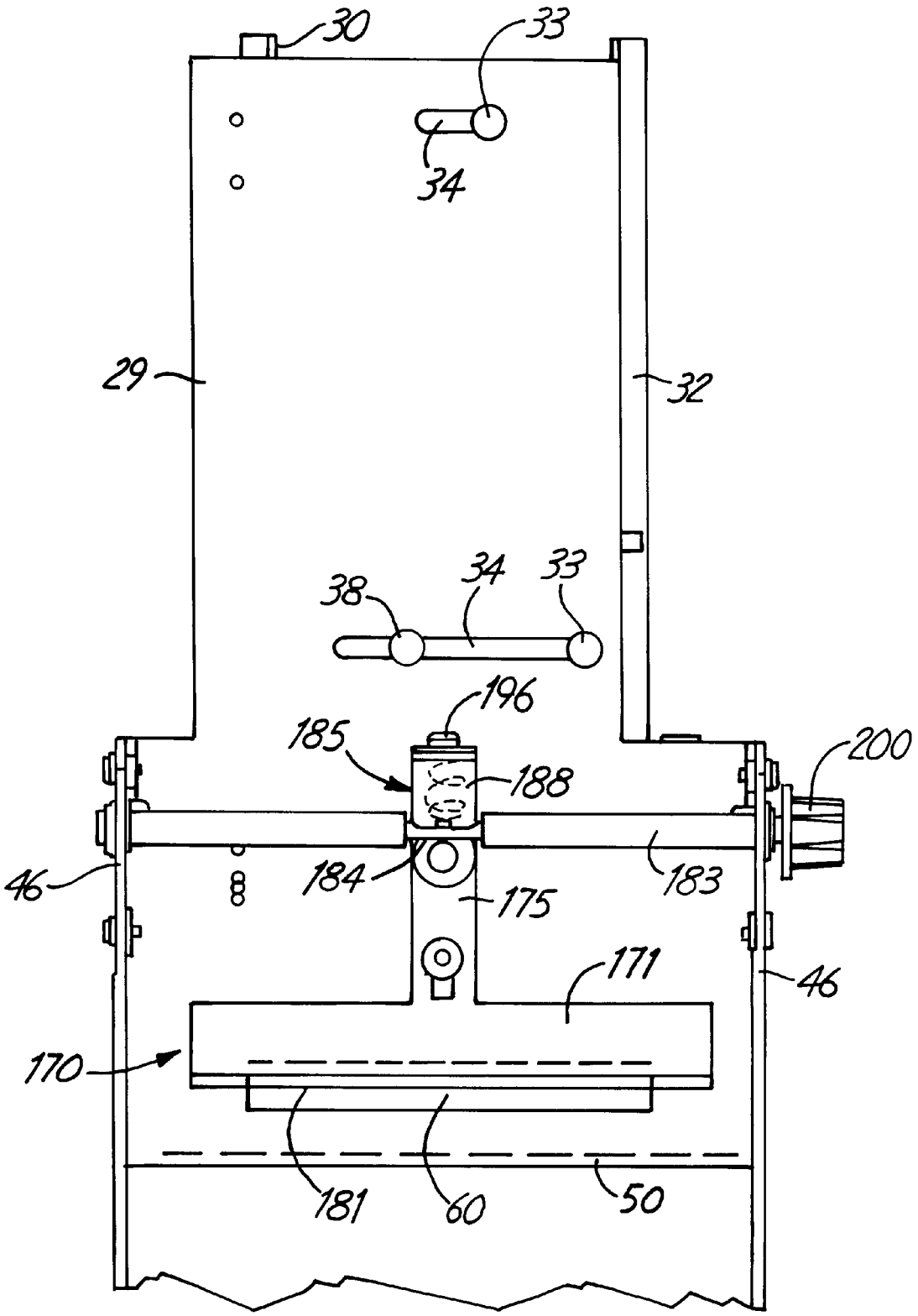
FIG. 7 is a front view of the card hopper.

The card feeder and encoder assembly 14 includes the card hopper 18 which has a stationary vertical end wall 29 and a fixed side guide wall 30. A laterally adjustable side guide wall 32 is adjustable relative to wall 30 to permit the hopper to handle cards of different widths. The adjustable wall 32 is slidably mounted on wall 29 using pins 33 on a flange 32A of wall 32 sliding in slots 34 in end wall 29 (see FIG. 7). A spring loaded lever 36 is pivoted as at 38 to the wall 32, and has a flange 39 with a friction or brake pad 40 that will engage a side portion 29A of wall 29 under spring load from a spring 42 (see FIG. 4) so that when the lever 36 is depressed by pushing the outer end as indicated by the arrow 44. The brake pad will release from the wall portion 29A and the side wall or adjustable guide 32 can be moved along slots 34 to change the spacing between the side wall 32 and the fixed side wall 30. The lever 36 has a slot 37 that has a guide pin 37A therein to guide movement.

The input hopper and encoding assembly 14 has side frame walls 46 that are spaced apart (see FIG. 2) and supported on a plate 47 to form a frame 48, which includes wall portion 29A that joins walls 46. The walls 46 are used for supporting the necessary components for operation. An input end cross plate 50 also connects the two frame walls 46 together and is formed with upright walls 29A and 29 which cards illustrated generally at 55 (FIG. 4) will abut when they are in position between the side guide walls 30 and 32.

Figure 5:
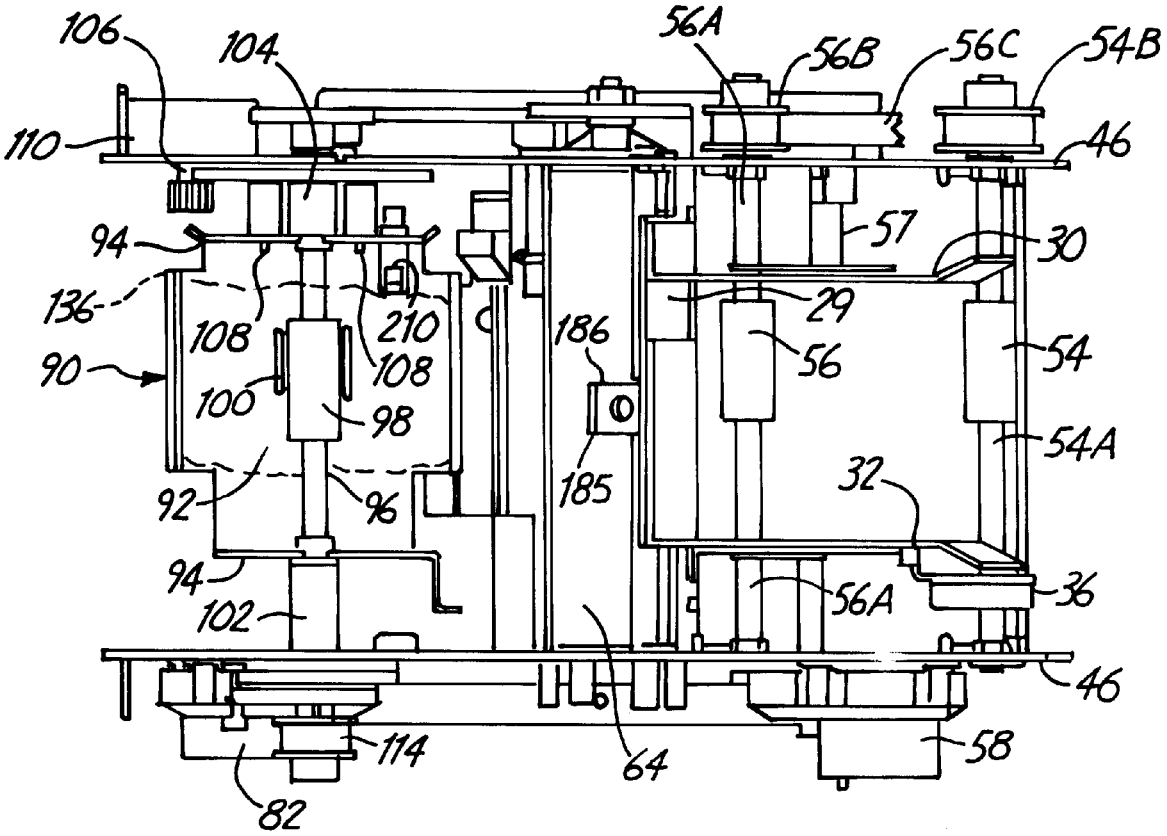
FIG. 5 is a top view of the card hopper and a flipper table assembly.

Cards that are in the hopper will rest on a pair of card drive rollers (see FIGS. 3 and 5) including an outer drive roller 54, and an inner drive roller 56, which are mounted on shafts that are supported in the side frame members 46 as shown in FIG. 5. The drive rollers 54 and 56 are driven from a common motor 58, which is a stepper motor that drives a cross shaft 57 with a pulley 57A (see FIG. 6) that drives a shaft 56A for the roller 56, and the shaft 54A for roller 54 with a belt 57B on the opposite side from the motor 58. The belt 57B drives a pulley 56B and a pulley 54B on shafts 56A and 54A for the rollers 54 and 56. It can be seen that the pulley 56B is smaller than the pulley 54B, so that the roller 56 is driven at a higher rpm than the roller 54, to tend to insure a positive feed of the card.

It also can be seen that the plane of the axes of the shafts 54A and 56A is less than 90° relative to the plane of the end wall 29 of the hopper 18. The support plane 55A (FIG. 3) of the cards resting on top of rollers 54 and 56 also is at an angle relative to the card support plane (horizontal) on the output side of the hopper. The wall 29 is inclined from vertical forwardly (toward the printer) in upward direction as well. The plane 55A is about 5 degrees up from the generally horizontal support plane of the cards on the output of the hopper. The wall 29 is about 3 degrees forwardly from the vertical line. The cards then tend to slide downhill and the leading edge surfaces of the cards are at a small angle relative to the wall 29 so that they slide on a corner of the card, and are less likely to hang up.

The pulleys 54B and 56B drive the shafts 54A and 56A through one-way clutch hubs 54C and 56C. The drive is in clockwise direction in FIG. 6.

The rollers 54 and 56 are driven by motor 58 to move cards 55 out of the hopper 18 through an outlet opening slot 60 in the wall 29.

Figure 12:
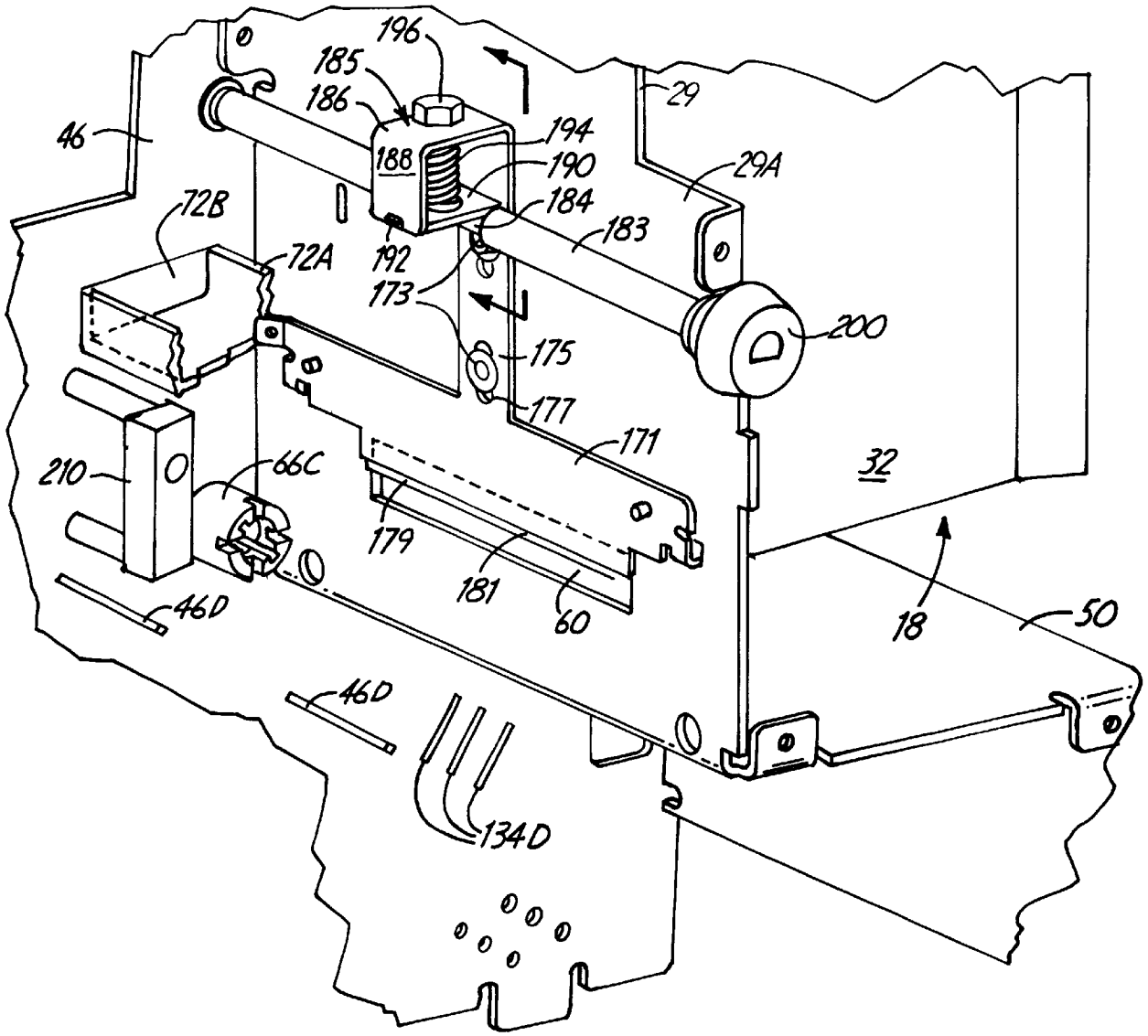
FIG. 12 is a fragmentary perspective view of the card thickness adjustment for the exit slot from the card hopper.

The outlet opening 60, is controlled as to size, so that only an individual card will be fed, and the thickness of the cards, which is the dimension perpendicular to the plane of the cards may vary, and the adjustment device shown generally at 170 in FIG. 12, is utilized.

The opening 60 in the wall 29 and 29A is aligned so that it has adequate width and actually is a larger opening than is required for the passage of a single card.

A gate 171 is slidably mounted on a pair of support pegs or posts 173, 173 affixed to the wall 29. The gate 171 has a support tang or strap 175 that has slots 177 that fit onto the posts 173. Suitable washers and fittings can be utilized for holding the strap or tang 175 in position, so that it will slide up and down the posts 173.

The main wider portion of the gate is a sandwich construction that traps a rubber blade or strip 179, and holds the rubber strip in position aligned with the opening 60 as can be seen. The rubber strip 175 can be held in the gate in any desired way, and has a small edge portion 181 that protrudes down below the edge of the gate, so that it is somewhat flexible, and yet provide a braking force.

Figure 13:
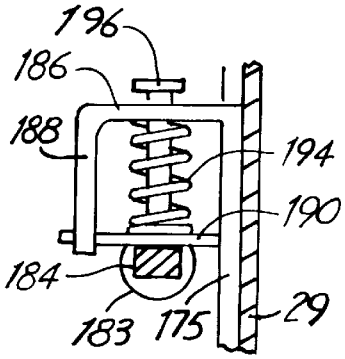
FIG. 13 is a sectional view taken generally along line 13—13 in FIG. 12.

The position of the lower edge of the flexible strip or blade 181 is controlled by a cam type shaft 183 that is rotatably mounted on the side wall 46 in a suitable manner, and spans between the side walls. The strap 175 extends upwardly above the shaft 183 and has a channel shaped assembly 185 formed thereon, with a top wall 186, and a depending wall 188. The depending wall 188 supports a movable cam follower plate 190 that is held with a small pivoting tab 192 to the wall 188, and this wall 190 rests upon a cam section 184 of the shaft 183. A spring shown at 194 is trapped between the wall 186 and the cam follower plate 190, and it is adjustable as to its compression force with a screw 196 in a conventional manner. As shown in FIG. 13, the shaft 183, and its cam section 184 is made so that it has four different positions (the cam is a square cam) with the surfaces of the cam 194 at different distance from the center rotational axis of the shaft 183 so that at each of the four positions, the gate would be adjusted to four different levels. The shaft 183 has an actuator knob 200 accessible from the outside of the card feeder, so that the position of the gate can be changed manually by rotating the shaft 183 by using the knob 200.

In this way, the vertical height between the lower edge of the flexible flap 181 and the lower edge of the opening 60, which is the outlet opening for the cards from the card hopper, can be adjusted to suit the particular thickness of cards.

Figure 14:
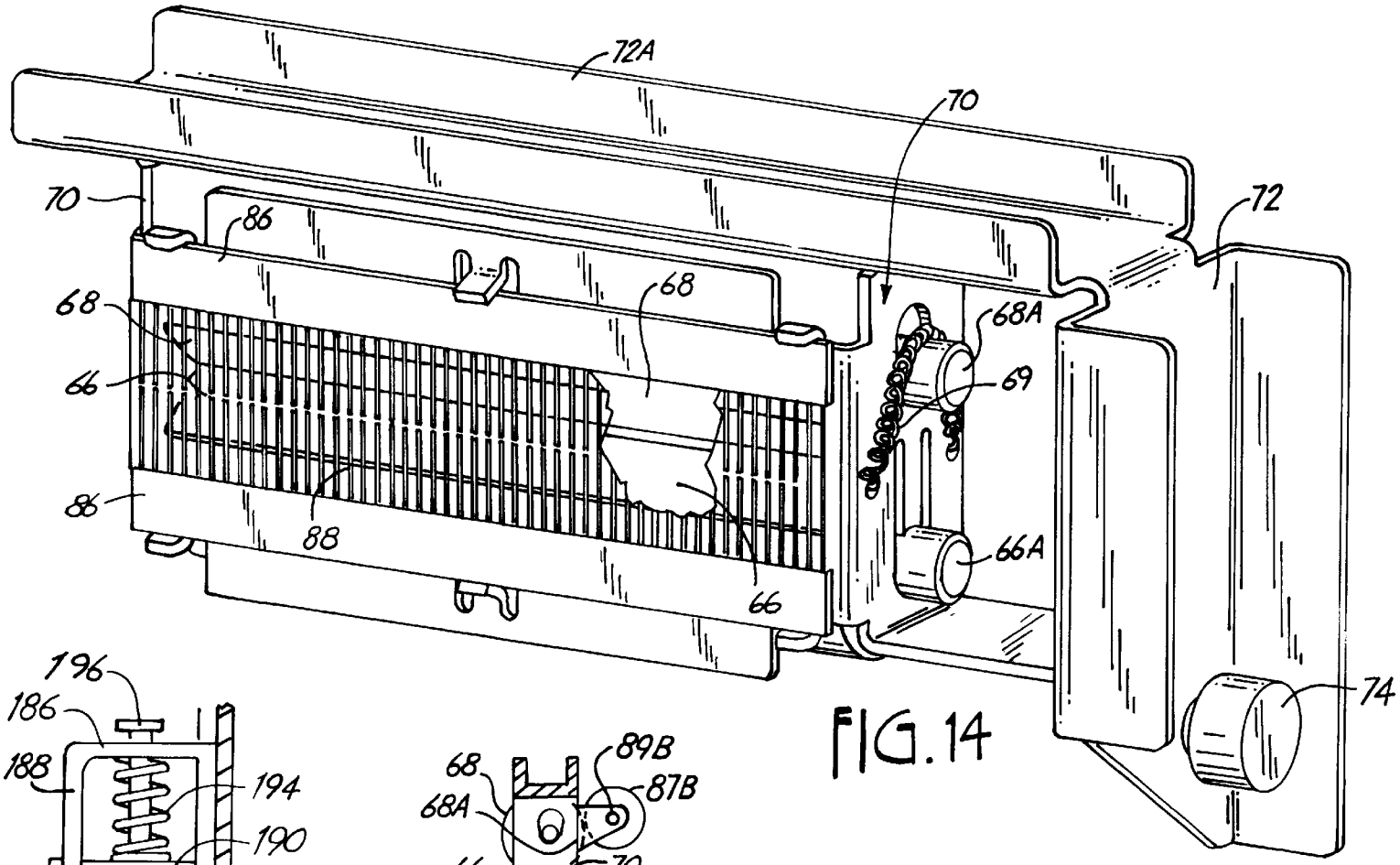
FIG. 14 is a perspective view of a cleaning roller assembly used with the present invention removed from the card feeder.
Figure 14A:
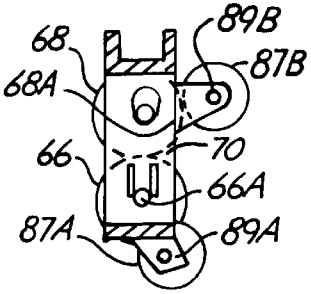
FIG. 14A is a schematic end view of the cleaning rollers showing optional lint pick up rollers in place.

The cards are passed through a pair of cleaning rollers, as they exit the hopper, forming a cleaning roller module 64 (FIGS. 5 and 14). The cleaning rollers in the module 64 include a lower driven roller 66 and an upper idler roller 68. These rollers are mounted on individual shafts 66A and 68A, shown in FIGS. 14 and 14A, in a suitable support housing 70. The support housing 70 is removable and replaceable by slipping it in between the side walls 46 through an opening 76 in one side wall, with an outer bracket 72 on the exterior of the side wall 46, and a thumb screw 74 is utilized for clamping the module in place in the side wall. The bracket 72 has a cross channel 72A that is supported in an opening 72B in the other side wall (FIG. 12). When the thumb screw 74 is loosened, the entire cleaning roller assembly can be tilted slightly and then pulled out endwise, in direction toward the thumb screw 74. The support 72A forms a main back bone that will slide out that direction. The shaft 66A is driven from a gear 66B, shown in FIG. 6 through a coupler 66C shown in FIG. 12. The gear 66B is part of a gear drive train shown generally at 80 in FIG. 6 that is driven from a cross shaft, in turn driven by a suitable stepper motor 82 (FIG. 2). The cleaning rollers 66 and 68 will move a card, in that the upper roller 68 is spring loaded with a spring 69 shown in FIG. 14 to form a pinch roller in a normal manner. The frame 70 has cross members 86 which support electrostatic removing wands 88, which comprise a number of flexible fingers that will run against the surfaces of the cards that exit the hopper to remove electrostatic charge as the card moves through the rollers. The cleaning rollers have sticky surfaces that will pick up particles from the card surfaces.

As an option, lint pick up rollers 87A and 87B may be mounted on an auxiliary brackets 89A and 89B (see FIG. 14A) and can be idler rollers that engage and roll along the lower cleaning roller 66 and the upper cleaning roller 68. The lint pick up rollers 87A and 87B have an adhesive or sticky surface an will keep the cleaning rollers clean for an extended period of use. The lint pick up rollers 87A and 87B may be power driven with a motor, if desired.

Figure 3:
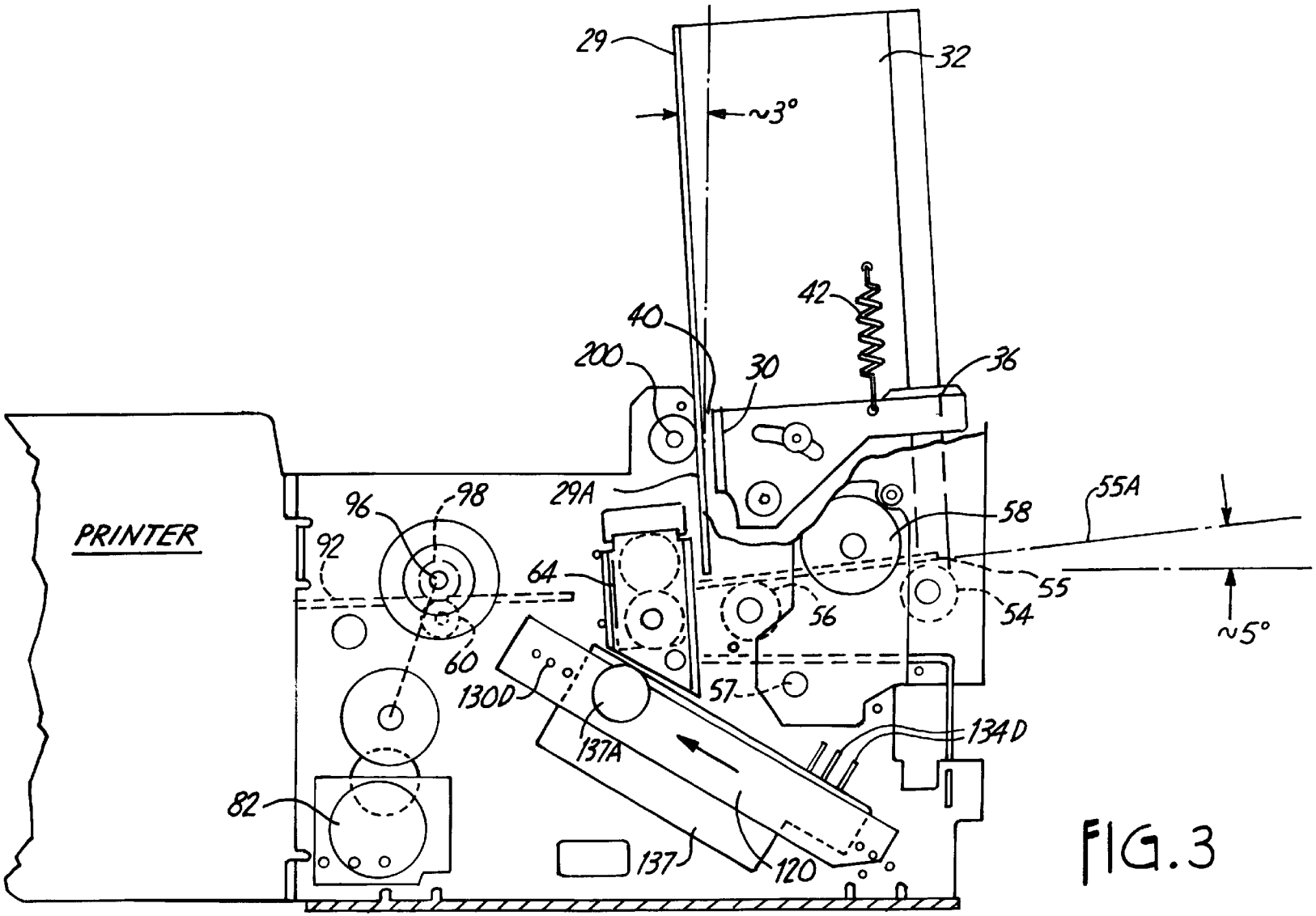
FIG. 3 is a simplified side view of the card input hopper and encoding station with parts in section and parts broken away.

After the cards move through the cleaning rollers 66 and 68, they are moved onto a flipper table assembly 90, which is a known flipper construction such as that shown in co-pending U.S. patent application Ser. No. 08/854,969, owned by the same Assignee and incorporated by reference. The flipper table assembly 90 is shown in the top view of FIG. 5, and includes a table or platform 92 that has upright end frames 94, 94 that are mounted onto a shaft 96. The shaft 96 is mounted in the side plates 46 and the shaft 96 mounts a roller 98 that is used for driving the cards relative to a pinch roller 100. The table 92 forms a card support plane that is aligned with the printer, but the table 92 can be inclined up also. The support plane 55A of the cards in the hopper is inclined relative to the table 92 plane as shown in FIG. 3.

Figure 6:
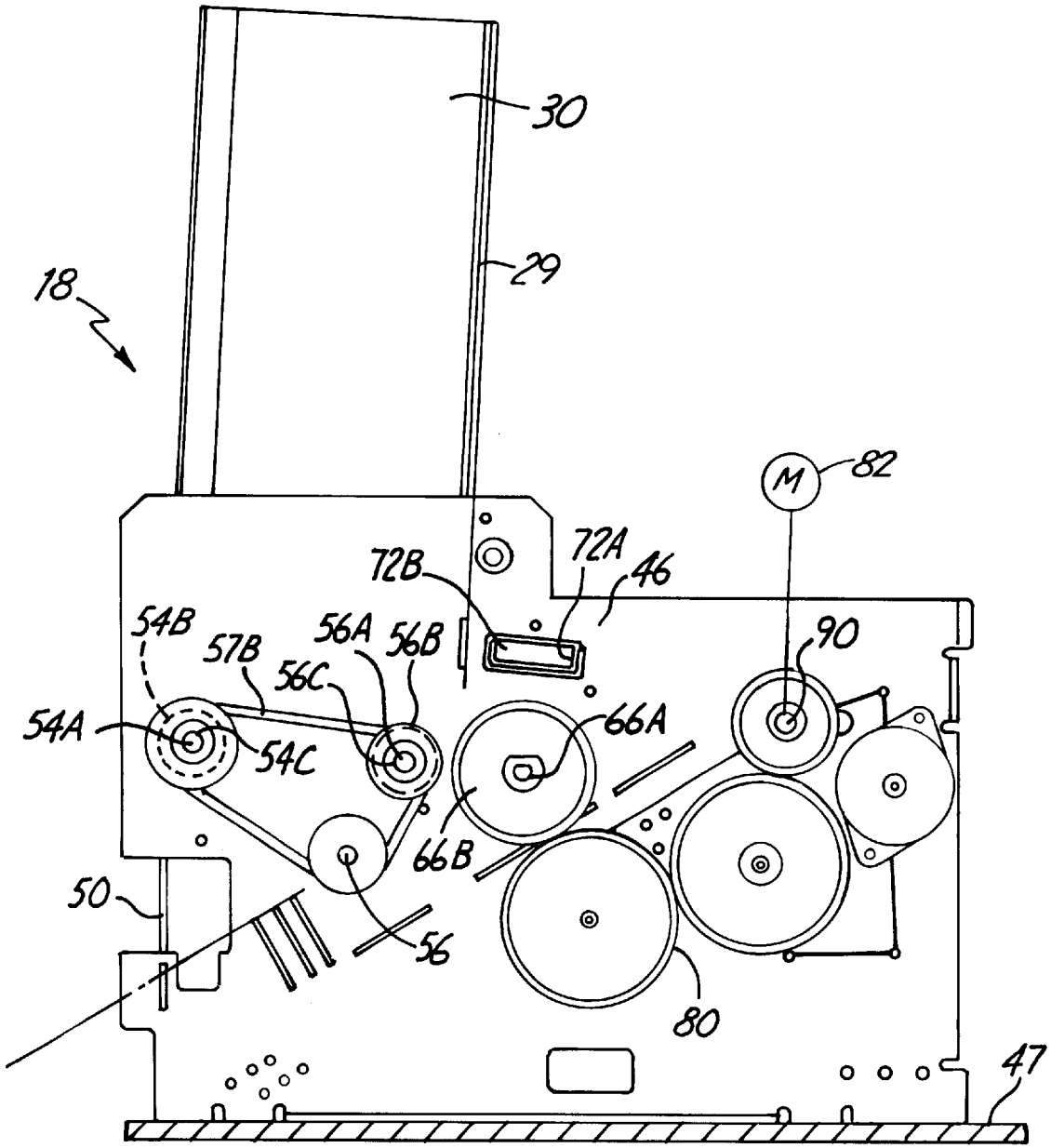
FIG. 6 is a side view of the card hopper and flipper table, taken from the opposite side of the machine from FIG. 3.

The table 92 is supported through flanges 94 on bearings 102 and 104 that permit the shaft 96 to rotate inside the bearings independently of the table. The table 92 held from rotation around shaft 96 and also is driven rotationally when desired by a gear train 106 that has drive lug members 108 engaging the flange 94 of the table, and is driven from a motor 110. The shaft 96 can be independently driven from the motor 82 driving through gear train 80 (FIGS. 3 and 6). That means that the card drive roller 98 can be independently driven or rotated relative to the table 92, but when the card being processed is received on the table, the table can be rotated to align the card with one of two different levels relative to an encoding module 120. When a card is received on the table 92 and held in place by stopping roller 98, as shown by dotted lines in FIG. 5, the roller 98 holds the card in position. Then the table 90 can be rotated a desired number of degrees and in a selected direction, either clockwise or counterclockwise as viewed in FIG. 3, by driving flipper table stepper motor 110 through gear train 106. The table 90 is also held in a desired position by the motor 110 and gear train 106 while shaft 92 is rotated by motor 82. The card on the table will be made to align with either an upper side or a lower side of the encoding module 120. The flipper table rotation can be limited by suitable stops but it can rotate 200 degrees or more to permit the flipping action.

Figure 8:
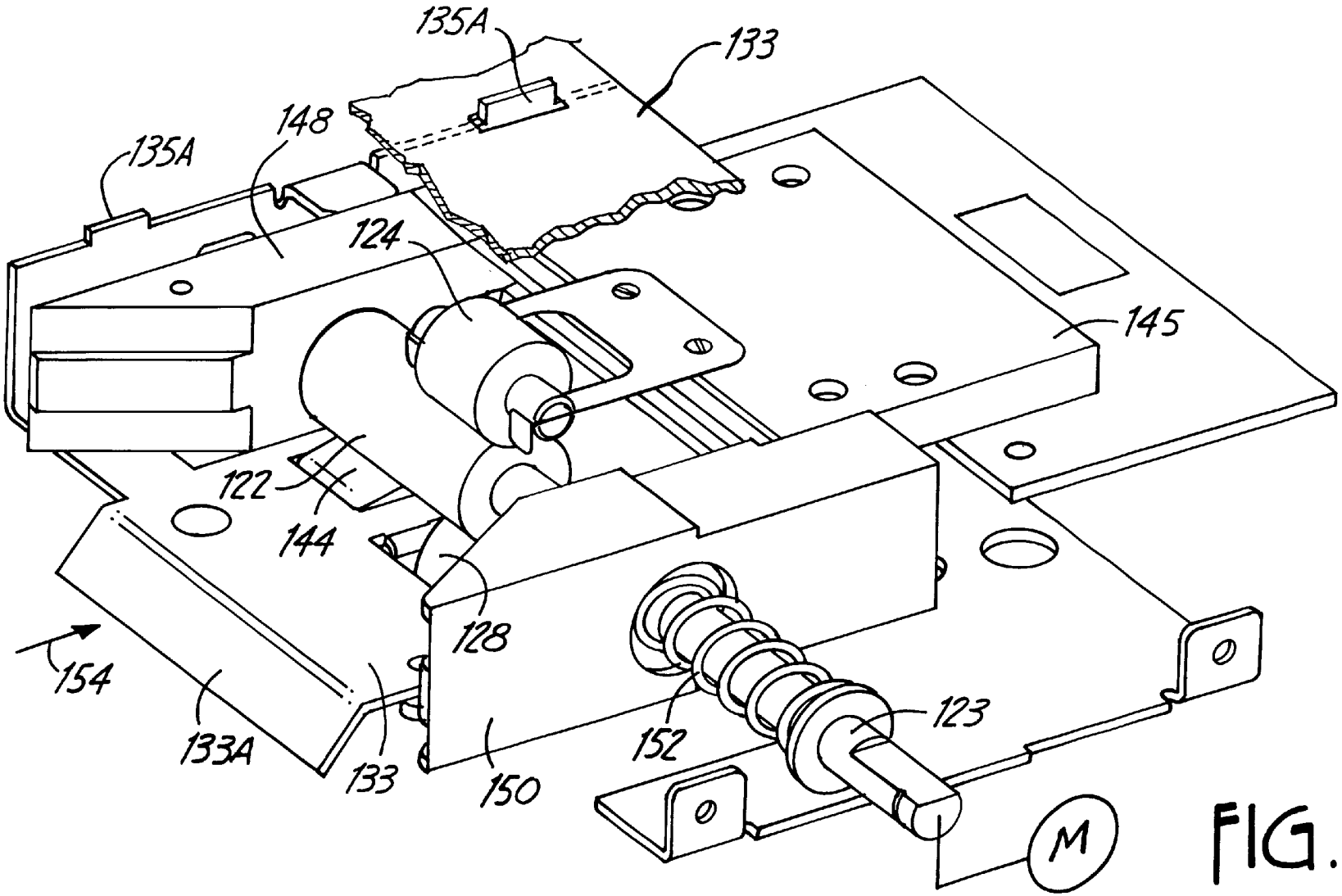
FIG. 8 is a schematic perspective view of a card encoding module used with the present invention with a top plate removed.
Figure 8A:
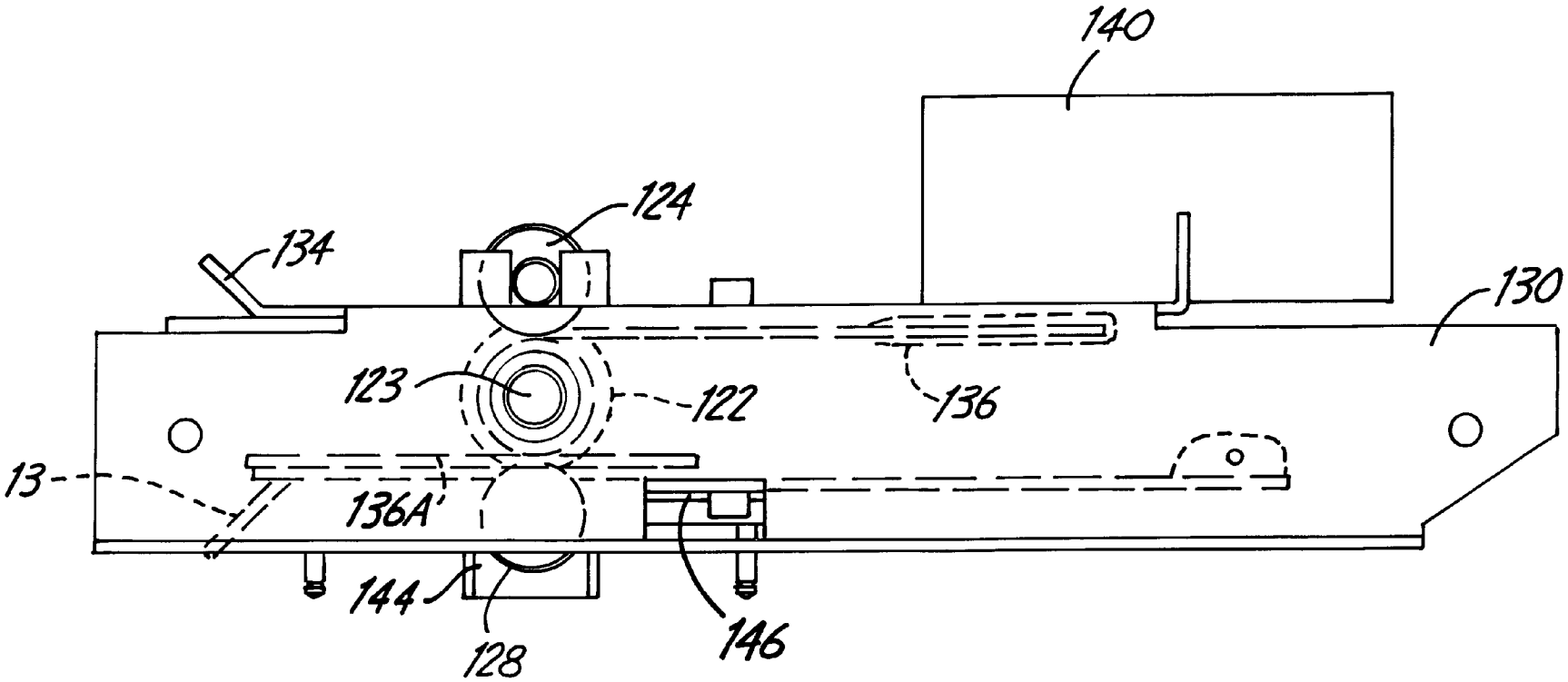
FIG. 8A is an end view of the encoder module.

The encoding module includes a frame that mount has a set of three rollers, including a powered roller 122 which is in the center and is engaged at an upper side by a pinch roller 124. The top side of roller 122 (FIG. 8) defines a proximity encoding level. A second roller or lower pinch roller 128 is an idler roller than engages the drive roller 122 and will guide and hold a card between the lower side of drive roller 122 and guide or pinch roller 128 for magnetic encoding.

The encoding module 120, as shown, is an independent module that is mounted between the side plates 46 of the card feeder frame. The encoding module forms a frame assembly 129 which includes a side wall member 130 that fits on the outside of one side wall 46 as shown in FIG. 2. The side wall member 130 is integral with a cross support plate 134 that overlies the encoder drive roller 122 and a lower cross plate 133 (see FIG. 9).

Figure 9:
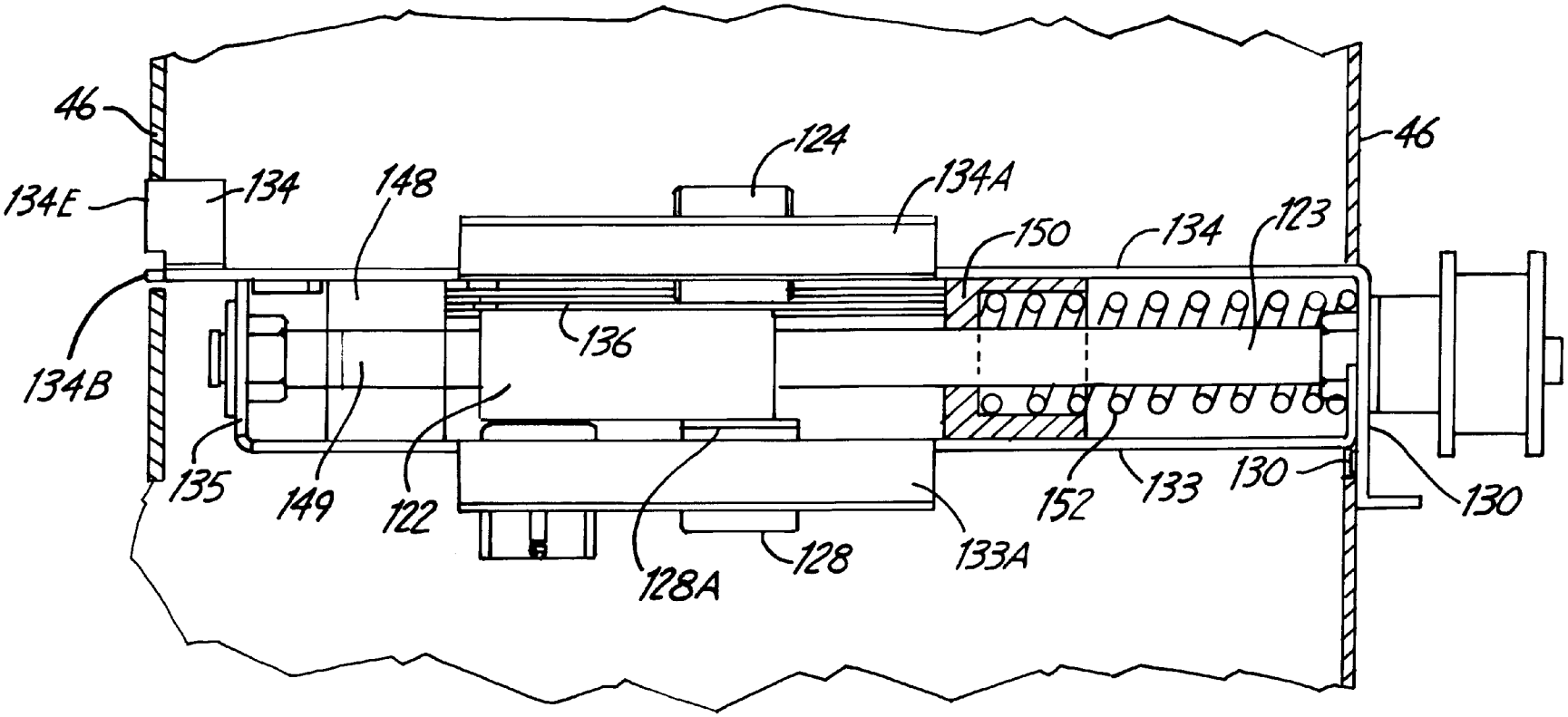
FIG. 9 is an end view of the encoding module looking toward the input end of the module.

An opposite end wall 135 is formed, as shown in FIG. 9, integrally with the cross wall 133, and is joined to the top plate 134 through the use of tabs and suitable fasteners. The tabs are shown in FIG. 10 at 135A and the end wall 135 is illustrated in dotted lines.

The top plate 134 has an upwardly flared guide 134A, which will guide or deflect an end of a card being inserted into the top or proximity encoding station, and the bottom cross wall 133 has a flange 133A that likewise will guide a card being inserted into a lower magnetic encoding station between the roller 122 and the pinch roller 128. These can be seen in FIG. 9, where a card illustrated at 136 is shown between the pinch roller 124 and the drive roller 122, but the roller 122 and the pinch roller 128 are in contact, but along the line 128A is where the card would be inserted for magnetic encoding. This is shown in dotted lines at 136A in FIG. 8. Plates 134 and 133, with their end walls 130 and 135 are fastened together as an assembly, and there is a space between the plates as shown perhaps best in FIG. 9. In addition, the edge of the plate 134 on the side opposite from the wall 130 extends out from the wall 135, and has locating tabs 134B protruding therefrom at selected locations that will fit into slots 46D in the opposite side wall 46, as shown in FIG. 10. There, the wall 46 is shown in dotted lines. These slots 46D in the wall 46 on the opposite side of the frame from the mounting of the wall 30 also has some vertically or uprightly extending slots shown at 134D in which a tab 134E of the wall 134 is placed. The tab 134E is mounted on an upright flange 134F, and this flange 134F can be seen in FIG. 9, with the wall 46 also illustrated for the tab 134E. A series of these slots 134D are provided along the wall 46 so that the encoding station can be adjusted (see FIG. 3 where the slots 134D are shown), and both the side walls 46 will have these slots, since the tab 134F has to pass through the wall 46 adjacent the wall 130 to be inserted and slid over to the other side. The openings for the tabs 134B are also shown, in FIG. 12 and the openings 46D for these tabs 134B are maintained at positions and are of length so that the entire module 120 can be moved to different positions along the plane of the module as shown in FIG. 3.

Figure 10:
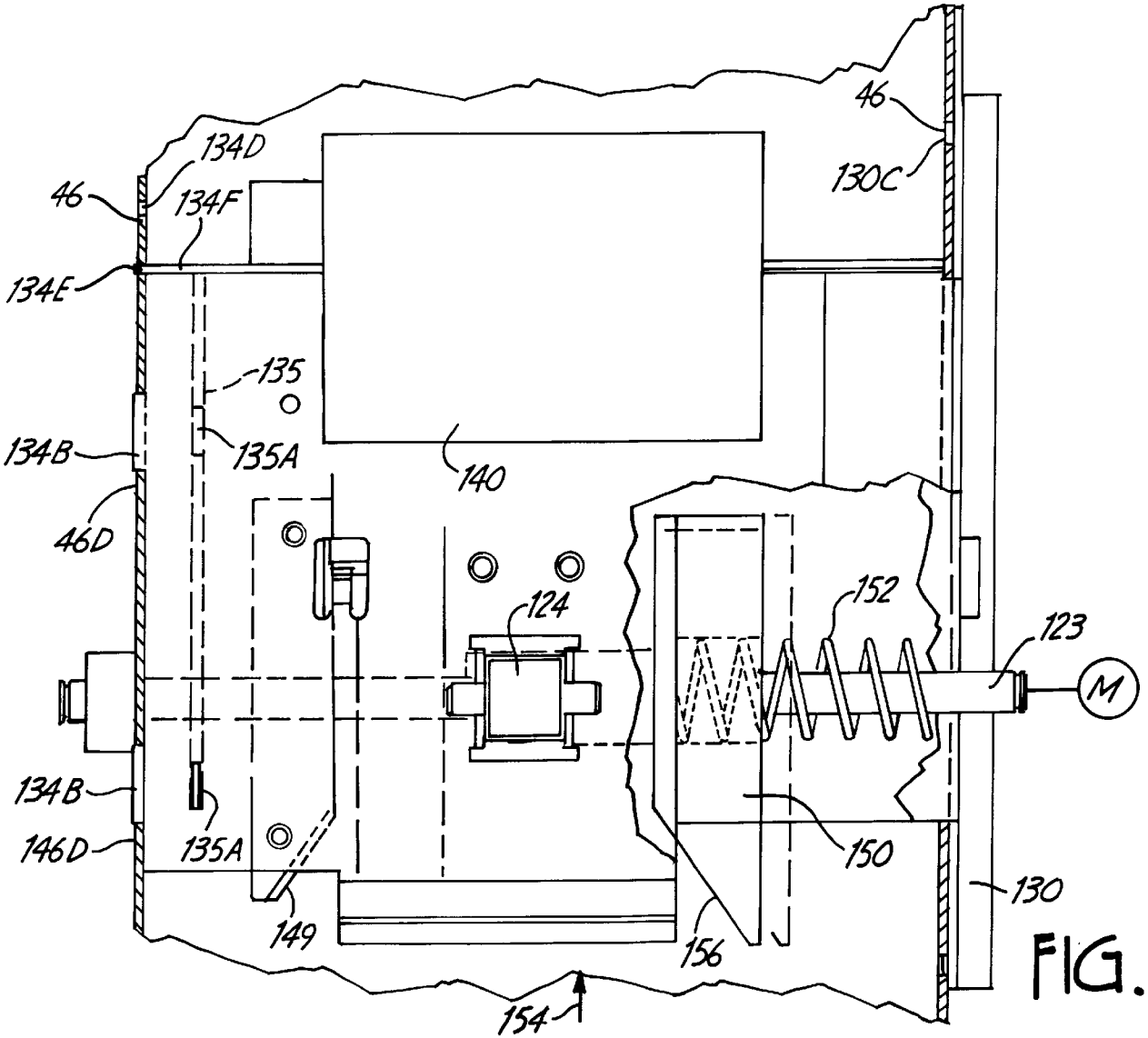
FIG. 10 is a top view of the encoding module of FIG. 9 with parts in section and parts broken away.

Additionally, locating additional partial punchouts are provided on the wall 130, as shown at 130C in FIGS. 9 and 10, for example, to fit into openings 130D shown in FIG. 3, which are positioned also so that the module can be adjusted in direction along its plane, as well as somewhat adjusted along its level.

The wall 46 as shown in FIG. 3, which is the left side, adjacent the wall 46 has an opening 137 for permitting the frame 129 of the encoding station to be inserted as a unit, and then held in place with a suitable screws or fasteners 137A as shown in FIG. 2.

The entire module 120 can be removed readily, for servicing or for changing the encoding circuitry.

The proximity encoding assembly 140 is provided on the wall 134, in position to transmit encoding signals to a card shown in the position 136, when a card has been inserted into the encoding assembly. Magnetic recording head 144 is provided on the module for encoding magnetic strips on cards inserted into the position shown at 136A. As is known, the magnetic head reads the encoding for verifying that the correct information has encoded on the card. As stated, if the card does not properly encode the correct information or is in some way defective, it can be repeated before printing to effect a cost savings. Also, a SmartCard encoder 145 can be provided.

Figure 11:
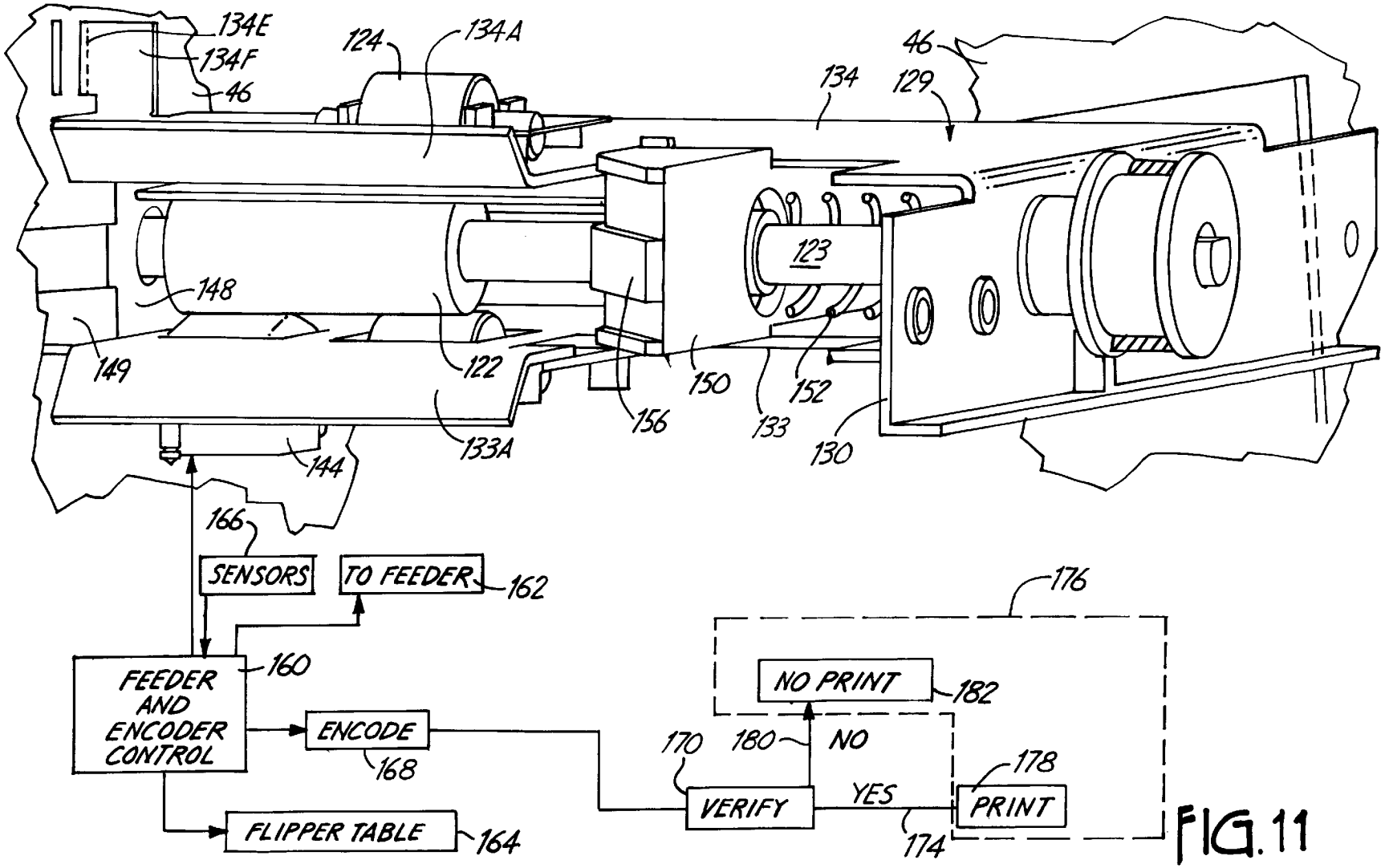
FIG. 11 is a fragmentary enlarged view of the encoding module from the input end and from the lower side of the module and a schematic block diagram of controls and the steps used in encoding.

In FIG. 11, schematically, a control 160 is illustrated. The control 160 is for the feeder and encoder controls, and includes connections to the feeders indicated at 162, and to the flipper table indicated at 164. This will control the sequencing of the motors that are used for driving the cards, and initiating the various sequences of operation. Inputs from sensors indicated at 166 provided for the controls to ensure that the steps to be carried out, as has been described, are completed and the cards are properly positioned and transferred to the selected stations. The feeder and encoder controller is shown connected to the magnetic head 144, but can also be connected to the other encoding stations, as desired. The sequence in the encoding can include the step of encoding represented at 168, and then a verification step 170 that will verify whether the card is properly encoded, and whether or not the card is defective. The verifying step can provide a signal that indicates the card is properly encoded along a line shown at 174, which would be a "YES" signal, and it would be a signal to a printing controller 176 to print, as shown at 178. If the verifying signal indicates that the card is not properly encoded, or the card is defective or otherwise a reject, a NO signal is provided along line 180 to the printing controller 176, indicating no print, as at 182. Thus, a defective card, or an improperly encoded card, can be followed by a signal indicating that it should not be printed because of an encoding problem, thereby saving the cost of the printing step, which is, in the overall encoding and printing process of card, a significant cost factor for individual card.

The plate 134 supports the upper pinch roller 124, for the SmartCard level encoding, and in combination with the center drive roller 122 will position a card shown in dotted lines at 136 adjacent to a proximity antenna assembly 140 or encoder 45. Antenna assembly 140 is mounted onto the encoding module in a suitable manner, and when the card is positioned adjacent the antenna assembly 140, the antenna assembly can be energized either from the printer micro-computer control or from a remote host control computer to provide encoding information the card 136, which would be a card containing a memory device.

When a magnetically encoded card is being processed, the flipper table 92 would be rotated so the card held thereon is at a lower level relative to the encoder module, and positioned in an inverted position from that which would provide the specific card 136 to the proximity encoding station. The card is at a lower level relative to the encoding station, and is driven to be held between the pinch roller 128 and the drive roller 122, and then driven to wipe a magnetic strip on the card across the magnetic head 144, as shown in dotted lines at 136A. It is to be understood that the card would be supported above the lower wall 133. Only one or the other of the encoder heads would be operable at a time, for the types of cards that are to be used, although some cards may have both a memory device that needs proximity encoding as well as a magnetic strip. The encoding would be done sequentially for the encoder.

In FIGS. 8–11, it can be seen that a fixed edge guide 148 is mounted between the upper plate 134 and plate 133. Guide 148 forms a fixed reference guide edge positioning the cards properly for the encoders. A sliding edge guide 150 is slidably mounted over shaft 123 and slides between the plates 134 and 133 to guide the other edge of the card. Sliding guide 150 is spring loaded with a spring 152 that mounts around drive shaft 123 for the drive roller 122.

This automatically provides for cards being inserted into the encoding station in a direction as indicated by the arrow 154. The guide 150 has a tapered card guide surface 156 and the stationary or fixed edge guide 148 so that the cards are guided into position easily.

Thus, the entire encoder module can be removed as desired, and adjusted as to position along a plane of support of the cards, that is, toward or away from the flipper table 92. The encoder sliding edge guide 150 and its relatively soft spring 152 provides an urging force that urges the cards against the fixed edge guide so that a position is known, and driving can occur.

The cards are positively fed by providing for the inclination of the plane of movement of the cards from the hopper to the indexing table 92, and the indexing table as shown is cocked up slightly from a generally horizontal or planar position, but is made so that it will align with the printer feed in rollers.

In operation, a sensor 210 is mounted onto the side wall 46 as shown in FIG. 12, and is made to sense a card exiting from the cleaning rollers, so that when the card is gripped in the cleaning rollers, the drive to the top or bottom rollers 54 and 56 is stopped, and the card is then pulled out by the cleaning rollers. The one-way clutch system permits this action to occur. Also, because the card roller 56 is driven faster than the roller 54, there is an action to insure that the cards will not be jammed or pushed, but rather will be pulled at all stages of movement.

Also, the wall 50 acts as an RF shield for cards in the hopper when radio frequency encoding is being used.

Although the present invention has been described with reference to preferred embodiments, workers skilled in the art will recognize that changes may be made in form and detail without departing from the spirit and scope of the invention.

What is claimed is:

1. A card feeder assembly including;

a hopper for storing a stack of cards to be fed, the hopper having side walls, and at least one of said side walls being adjustable to vary spacing between the side walls to accommodate different widths of cards;

a friction brake for holding the least one adjustable side wall in a position relative to the other side walls;

a card drive for urging an end card of the stack in the hopper, said card drive being driven to move cards in a first direction, the card drive forming a support plane for an end card in the stack;

a wall of said hopper having a controllable size card outlet opening therethrough aligned with the end card in the stack of cards and through which the end card is fed when driven by the card drive; and a control gate at said outlet opening for adjustable reducing a dimension of the outlet opening in the wall related to a thickness of the cards in the stack for permitting one card to pass through the reduced dimension opening formed by the control gate.

2. The card feeder of claim 1, wherein said control gate includes a resilient blade defining an edge of the outlet opening.

3. The card feeder of claim 1, wherein said card drive comprises a pair of rollers at one end of said hopper which form a support plane for said stack of cards that is inclined relative to a support plane for the cards after the cards move through the reduced dimension opening and exit the hopper.

4. The card feeder of claim 3, wherein the individual rollers of the pair are operated at a differential in rotational speed.

5. The card feeder of claim 4, wherein said pair of rollers are both driven through one-way clutches, and a roller of the pair adjacent to the outlet opening is driven at a faster rotational speed than the other roller.

6. A card feeder assembly including;

a hopper for storing a stack of cards to be fed;

a card drive for urging an end card of the stack in the hopper, said card drive being driven to move cards in a first direction, the card drive forming a support plane for the end card in the stack;

a wall of said hopper having a controllable size card outlet opening therethrough aligned with the end card in the stack of cards and through which the end card is fed when driven by the card drive; and a control gate at said outlet opening for adjustable reducing a dimension of the outlet opening in the wall related to a thickness of the cards in the stack for permitting one card to pass through the reduced dimension opening formed by the control gate;

a table for receiving a card from the outlet opening, the table being rotatable about an axis transverse to the card, an encoding station inclined at an angle relative to the rotatable table, said encoding station having card edge guides, at least one of said card edge guides being slidably movable relative to the other, and a spring loading the at least one slidably movable card edge guide toward the other card edge guide across a selected range of movement.

7. The card feeder of claim 6, wherein said encoding station is a module that is insertable and replaceable on side frame walls of the card feeder.

8. The card feeder of claim 6 and a pair of driven cleaning rollers mounted between the outlet opening and the rotatable table for receiving and driving a card moving out of the outlet opening.

9. The card feeder of claim 8, wherein said cleaning rollers comprise rollers having a sticky surface that will drive the card onto the rotatable table and remove particles from the card.

10. The card feeder of claim 9, and at least one lint pick up roller mounted to engage at least one of the cleaning rollers for removing particles from the at least one cleaning roller.

11. The card feeder of claim 8 and static electricity removal screens engaging a card exiting the cleaning rollers.

12. The card feeder of claim 8, wherein said cleaning rollers are mounted on a separate frame, said frame being insertable and replaceable through an opening in a card feeder side wall and supported on an opposite card feeder side wall to span across the space between the card feeder side walls.

13. The card feeder of claim 8, wherein said card drive comprises a pair of drive rollers at one end of the card hopper, the drive rollers being driven through one-way clutches, and a sensor for sensing a card exiting the cleaning rollers to provide a signal to disable the drive to the one-way clutches so a card is pulled through the outlet opening by the cleaning rollers.

14. The card feeder of claim 6, wherein said encoding station has a magnetic head for encoding information onto a magnetic strip on a card, and selectively has a non contact encoding portion at a different elevation than the magnetic head.

15. The card feeder of claim 14, and a control for controllably encoding information onto the card, verifying the encoded information, and providing a signal indication whether the card is properly encoded and ready for printing.

16. The card feeder of claim 15, wherein the control provides a signal to indicate no printing to the card should occur if the card is not properly encoded.

17. The card feeder of claim 6, wherein said rotatable table includes a drive roller for driving a card from the table toward a printer assembly.

18. A card feeder for a printer comprising a card hopper having an end wall, and a pair of side walls for defining a space in which a stack of cards is received;

at least one of said side walls being mounted on the card feeder for slidable movement relative to the other side wall to control the distance between the side walls of the hopper, said at least one side wall having a lever spring loaded in a first direction, said lever having a brake pad thereon that engages a portion of the end wall of the hopper, said lever being movable to release the brake pad from the end wall and to permit movement of the at least one side wall relative to the other side wall, release of said lever engaging said brake to hold the at least one side wall in position;

a card support at the bottom of said hopper including at least one drive roller for driving a bottom card of a stack of cards in the hopper in a first direction toward the end wall;

said end wall having a card outlet opening therein through which a card driven by the at least one roller moves;

a card handler comprising an indexing table for receiving and supporting a card from the outlet opening;

an encoding station offset from the path of travel of the card between the hopper and the card handler, said indexing table being tiltable to align a card thereon with the encoding station and move the card to the encoding station, said encoding station being adapted to receive a card and encode information onto the card prior to printing; and a drive for said at least one roller, said support for the stack of cards being inclined relative to a plane of the card handler that receives the card from the card hopper.

19. The card feeder of claim 18 and a control gate for adjusting the size of the outlet opening in relation to a thickness dimension of the card.

20. The card feeder of claim 18, wherein said control gate has a rubber strip defining one edge of the opening.

21. The card feeder of claim 18, wherein said card support comprises a pair of rollers defining a plane at their peripheries for supporting a card on the plane, the plane being inclined at an angle relative to the card handler.

22. A card feeder for a printer comprising a card hopper having an end wall, and a pair of side walls for defining a space in which a stack of cards is received;

a card support at the bottom of said hopper including at least one drive roller for driving a bottom card of a stack of cards in the hopper in a first direction toward the end wall, said card support comprising a pair of card support rollers defining a plane at their peripheries for supporting a card on the plane, the plane being inclined at an angle relative to the card handler, said card support rollers forming the support plane for cards being driven at different rotational speeds through one-way clutches that permit the card support rollers to overrun a drive shaft for each of the card support rollers when cards are moved through the outlet opening;

said end wall having a card outlet opening therein through which a card driven by the at least one roller moves;

a card handler comprising an indexing table for receiving and supporting a card from the outlet opening;

an encoding station offset from the path of travel of the card between the hopper and the card handler, said indexing table being tiltable to align a card thereon with the encoding station and move the card to the encoding station, said encoding station being adapted to receive a card and encode information onto the card prior to printing; and a drive for said at least one roller, said support for the stack of cards being inclined relative to a plane of the index table of the card handler that receives the card from the card hopper when in a card receiving position; and a pair of cleaning rollers to receive a card coming through the outlet opening, said cleaning rollers driving the card at a speed that is greater than the driving speed of the card support rollers.

23. The card feeder of claim 22 and a sensor sensing when a card is being driven by the cleaning rollers and providing a signal to disable a drive to the card support rollers.

* * * * *

UNITED STATES PATENT AND TRADEMARK OFFICE

CERTIFICATE OF CORRECTION

PATENT NO. : 6,315,283 B1
DATED : November 13, 2001
INVENTOR(S) : Darren W. Haas It is certified that error appears in the above-identified patent and that said Letters Patent is hereby corrected as shown below:

Column 8,
Line 50, before “least” insert -- at --.
Line 60, cancel “adjustable” and insert -- adjustably --.

Column 9,
Line 24, cancel “adjustable” and insert -- adjustably --.

Signed and Sealed this

Twenty-eighth Day of January, 2003

JAMES E. ROGAN
*Director of the United States Patent and Trademark Office*